United States Patent [19]

Timberlake, Jr.

[11] 4,438,792

[45] Mar. 27, 1984

[54] PRESSURE RELIEF ALERT

[75] Inventor: George A. Timberlake, Jr., Macungie, Pa.

[73] Assignee: Air Products and Chemicals, Inc., Allentown, Pa.

[21] Appl. No.: 334,754

[22] Filed: Dec. 28, 1981

[51] Int. Cl.[3] ..... B65B 3/04; B67C 5/32

[52] U.S. Cl. ..... 141/95; 116/212; 116/266; 116/DIG. 41; 220/DIG. 16

[58] Field of Search ..... 141/94, 95, 96; 116/266, DIG. 41, 212; 220/367, DIG. 16; 137/67–77

[56] References Cited

U.S. PATENT DOCUMENTS

| | | | |
|---|---|---|---|
| 3,115,862 | 12/1963 | Underwood | 116/266 |
| 3,493,044 | 2/1970 | Selph | 137/68 R |
| 3,504,687 | 4/1970 | Dunston | 137/68 R |
| 3,662,703 | 5/1972 | Jackson | 116/266 |

*Primary Examiner*—Houston S. Bell, Jr.

*Attorney, Agent, or Firm*—Mark L. Rodgers; E. Eugene Innis; James C. Simmons

[57] ABSTRACT

Pressure relief detecting/alert apparatus for detecting the activation of pressure relief devices associated with fluid storage is disclosed comprising a cover adapted to move in response to a release of stored fluid, a tube assembly for containing a control fluid under pressure and capable of rupture upon movement of the cover, and means for detecting a decrease in control fluid pressure.

13 Claims, 2 Drawing Figures

PRESSURE RELIEF ALERT

TECHNICAL FIELD

This invention relates to apparatus for the detection of pressure relief discharge from fluid storage.

BACKGROUND OF THE PRIOR ART

Bulk fluid storage systems having large storage tanks are used commercially to store fluids including oxidizing, flammable, toxic, and/or otherwise hazardous fluids at high pressure. When the nature of the product contained is potentially hazardous, bulk fluid storage systems are often situated at remote locations in consumer plants. Continuous charging systems have been developed for such storage systems located in remote areas, e.g., to pump fluids to high pressure and in the case of liquified gas storage to vaporize the high pressure liquid, for the purpose of charging the fluids to the bulk fluid storage tanks automatically. Pressurized bulk fluid storage tanks are outfitted with high pressure protection devices or pressure relief devices, e.g., safety valves or rupture discs, which blow down high pressure conditions when a predetermined pressure is exceeded in the tank. Because the storage tanks are remotely located, an activation of the pressure relief device may go undetected until large amounts of stored product are discharged.

SUMMARY OF THE INVENTION

The invention comprises means for detecting the activation of a pressure relief device in a fluid storage apparatus having a storage tank capable of holding a stored fluid under pressure. The detection means of the invention comprises a rigid cover adapted to move in response to a release of stored fluid from the storage tank; a tube assembly for containing a control fluid under pressure, the tube assembly having a member of reduced strength to facilitate rupture thereof upon movement of the rigid cover in response to the release of stored fluid; and means for detecting a decrease in pressure attendant with a release of the control fluid from the ruptured tube assembly.

The advantages in using the particular apparatus of my invention for the detection of a release of a stored fluid include the following:

- an ability to function with a reliability and simplicity unavailabe from detection schemes such as flow sensors or individual pressure switches on stacks;
- an ability to function without electrical service;
- an ability to provide for location of a transducer at a site remote from the site of the release of dangerous stored fluid;
- an ability to withstand the effects of environment and weather and to continue functioning notwithstanding the release of hazardous or flammable stored fluid;
- an ability to provide for easy testing and economical reactivation;
- an ability to be fail-safe by providing indication upon loss of control fluid not through activation of the pressure relief device;
- an ability to function without significant field adjustment for maintenance; and
- other advantages which will become evident from the illustrations of the detailed description that follows.

DETAILED DESCRIPTION OF THE INVENTION

Figure 1:
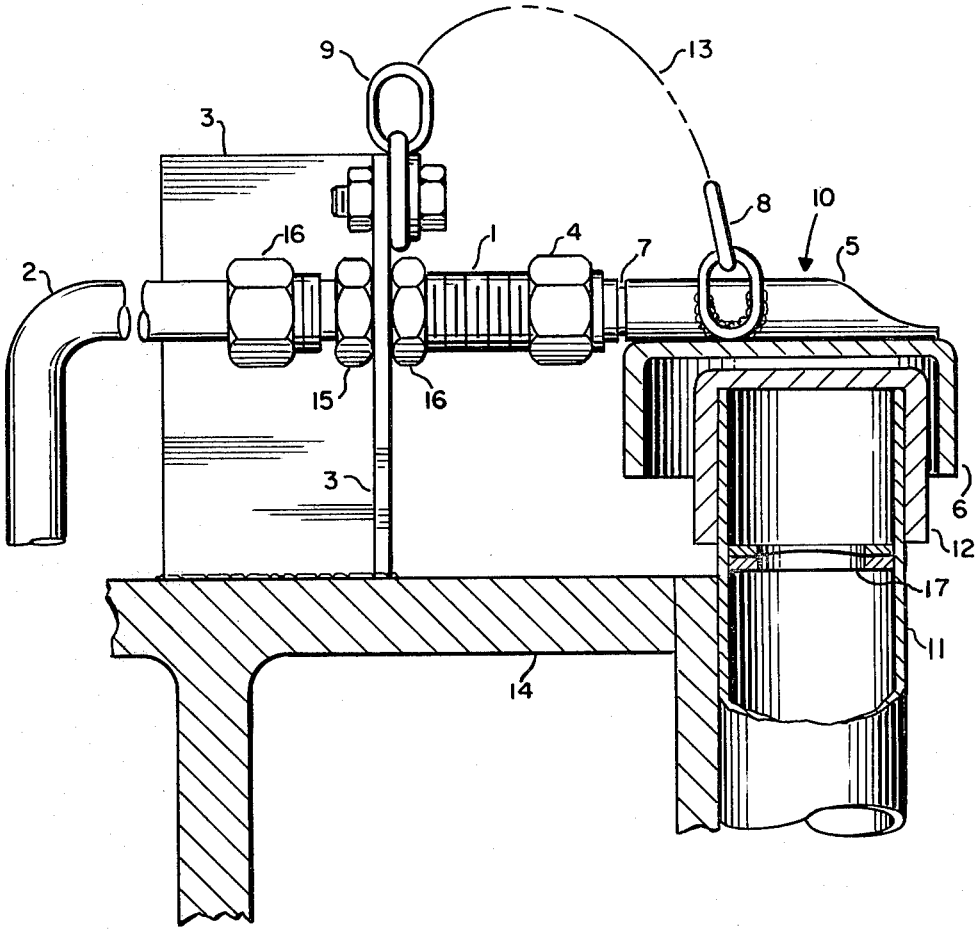
FIG. 1 represents a side view diagram of the present invention.

The pressure relief alert apparatus of the present invention is adapted for use on pressurized fluid storage tanks typically having a conduit for filling and withdrawing stored fluid and further including a pressure relief device, such as a rupture disc and holder or a pressure relief valve, having a fluid release port for discharging stored fluid when the pressure in the storage tank exceeds a predetermined pressure. The invention comprises improved detection means for sensing the activation of the pressure relief device and the attendant release of stored fluid.

A rigid cover is positioned over a fluid release port on the pressure relief device, which cover is adapted to move in response to a release of stored fluid through the port. The cover is adapted to allow contact with a pressurized tube assembly containing a control fluid, the tube assembly having a portion of reduced strength to facilitate a rupture in the assembly in response to movement of the rigid cover. In this way, rupture of the tube assembly caused by release of stored fluid from the storage tank releases the contained control fluid. The apparatus further incorporates a detection means for sensing the release of the control fluid from the tube assembly.

In one embodiment, the pressurized tube assembly comprises a pressurized line tube connected in a removable fashion to a length of indicator tubing juxtaposed to the rigid cover, which indicator tube has a circumferential groove to facilitate rupture of the tube by movement of the rigid cover. The pressurized line tube is fixed on one side of a support, which support is adapted to act as a cantilever support for the grooved indicator tube in order to facilitate rupture of the tube. A force plate can be fixed to the grooved tube to facilitate contact with the rigid cover. The force plate has a surface area complimentary to that of the rigid cover to enhance the uniform transfer of force to the grooved tube from movement of the rigid cover.

The detection means for sensing the release of control fluid from the tube assembly comprises a pneumatic switch which can be located at a position remote from the pressure release port or pressure release pipe outlet of the storage tank. Such an embodiment not only represents an improvement over coventional flow sensors or limit switches in terms of simplicity, but also advances the reliability and safety of the detection apparatus. For example, the detection means for sensing the control fluid release does not require electricity for operation, particularly at the location where hazardous fluid is venting. Remote positioning of an electrically powered sensing system will prevent fire from sparks being present at the vent location. However, in the event of fire at the release port, a remotely located transducer sensor will not be exposed to or destroyed by the fire. In this way the signal sent by the detection means will continue to provide an alert even though a destructive fire is burning at the release port. Release of toxic and otherwise dangerous or corrosive fluids similarly will not attack the remotely located transducer or destory its signal sending capability.

The pneumatic switch detection means can be adapted to activate an alarm, either by pneumatic, electrical, mechanical, or other means. The pneumatic switch can be viewed as a transducer, sensing pressure loss and causing a signal to be sent, such as an electrical or electronic signal to a shutoff device on charging means, e.g., an automatic pump for charging the storage tank. An otherwise continuous charging pump thereby can be shutdown to prevent an entire product supply or reservoir from being discharged to the atmosphere.

Referring to FIG. 1, a pressure relief detecting device according to the invention shown generally as 10 is positioned adjacent to closure 12 on pressure relief vent or stack 11 associated with the pressure relief device (not shown) on a storage tank for an oxidizing, flammable, and/or toxic fluid. Closure 12 is an impermeable rigid cover such as a plastic cap. A support 14 fixed to the storage tank, tank supports, or other structural member (not shown) can support vent pipe 11 and has fixed thereon a support 3. Support 3 can be an angle iron or other structural member adapted to hold an adapter conduit 1 which may be a threaded pipe nipple passed through an opening in support 3 and fixed thereto by nuts 15, 16. A tube 5 adapted to hold an indicator fluid under pressure is removably fixed to one end of adaptor conduit 1 as by compression fitting 4 as is well known in the art. Tube 5 can be closed on its projecting end by a crimp as shown or by any other means that will prevent leakage of pressurized fluid contained therein. A force plate 6 having a surface complimentary to and preferably slightly larger than cap 12 is fixed to tube 5 by conventional means such as brazing. Tube 5 and plate 6 are positioned so that when cap (cover) 12 moves as the result of fluid being vented from the tank, most of the force of the venting fluid will be transmitted to plate 6. Alternatively, fluid force can be applied directly to plate 6 if cap 12 is not used. Tube 5 includes a portion of reduced cross-section such as a circumferential groove 7 to facilitate rupture of tube 5 by the bending force or moment around support 3 caused by the force of venting fluid pushing cap 12 against plate 6 or, alternatively, directly against plate 6. The dimension of groove 7 can be selected to define the load under which tube 5 will rupture thus permitting a controlled amount of venting before the detecting device is activated.

A pressure line tube 2 is connected to the other end of nipple 1 such as by fluid tight compression fitting 16 as is well known in the art. Conduit or tube 2 is in turn connected to a sensing device such as a pressure switch, pressure transducer or the like (not shown) which in turn is connected to a detector or alarm device (not shown) which is activated when the pressure in line 2 is suddenly decreased by rupture of tube 5. Alternatively, the pressure transducer or sensing device can be connected to devices to control valves, fire suppression systems or the like either alone or in combination, as is shown in FIG. 2.

A chain 13 or other flexible restraint is fixed to support 3 and tube 5 to prevent excursion of tube 5 from the vicinity of support 3 when it ruptures.

Figure 2:
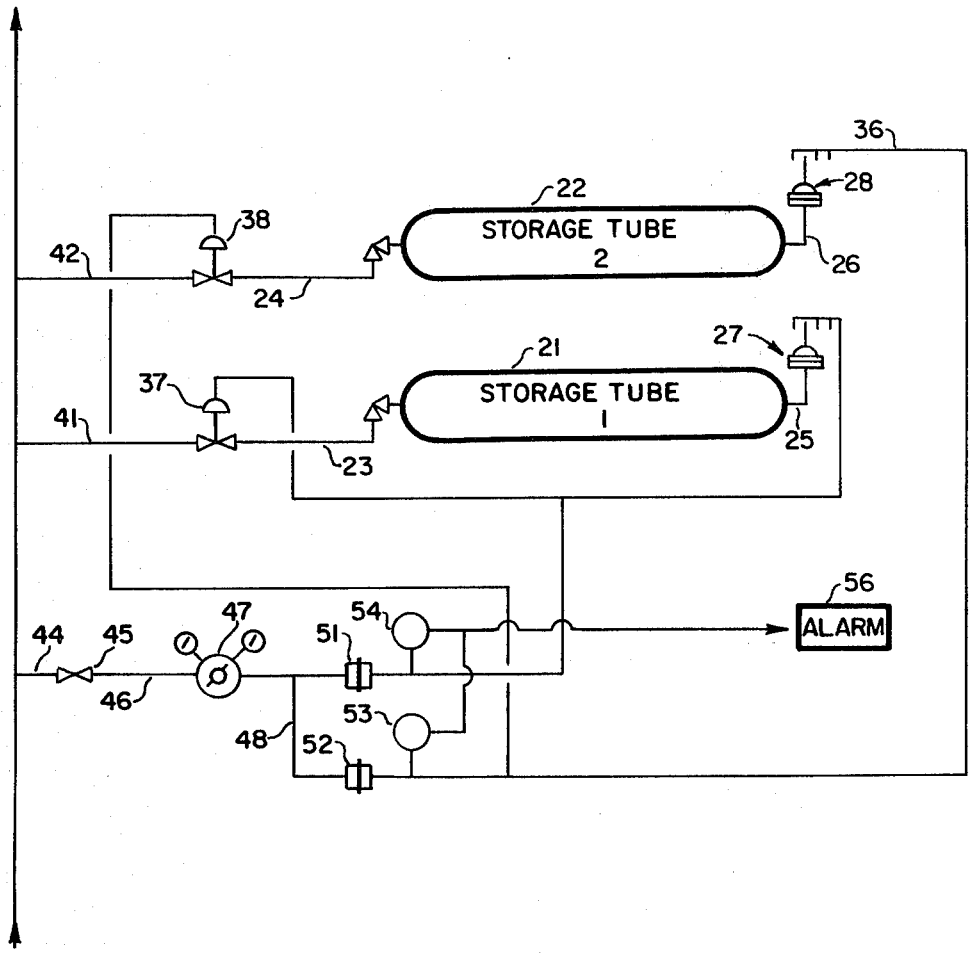
FIG. 2 represents a schematic of an overall fluid storage system incorporating the improved pressure relief alert apparatus of the present invention.

Referring to FIG. 2, a product storage system is shown having product storage tanks 21 and 22. Conduits 23 and 24 provide for filling and withdrawing stored fluid from storage tanks 21 and 22, respectively. Pressure relief detecting devices 27, 28 such as shown in FIG. 1 are positioned to detect fluid vented through pipes 25 and 26 associated with relief devices on tank 21 and 22, respectively. When the pressure within a storage tank (e.g., in tank 21) exceeds a predetermined pressure, the associated pressure relief device (not shown) activates and discharges stored fluid through conduit 25 which in turn activates pressure relief alert device 27. Upon rupture of the tube of alert device 27, line pressure in control line 35 drops and pneumatic valve 37 is activated to close off the supply of stored fluid through supply line 41. Source line 43 provides storage product for supply lines 41 and 42 and also supplies pressurized control fluid for lines 35 and 36 via line 44, valve 45, line 46, regulator 47, split line 48, and orifices 51 and 52. Orifices 51 and 52 provide for an orifice or other flow restriction in the supply of control fluid to each control line to restrict the source line supply flow to the control line thereby insuring that the pressure downstream from the orifice will decrease upon activation of the pressure relief alert device and at the same time providing a limited flow to compensate for small leakage in the system. Compensation for minor leakage will assure that the system does not activate prematurely.

Orifice sizing can vary depending on the line tube sizing and pressure contained in the line tube. For a control line of up to 50 feet in length of $\frac{3}{8}''$ tubing (0.030" wall, 0.3150" I.D.), a normal source line charge of 50 psig, and an alarm pressure of 25 psig, an orifice in the form of at least 5 feet of $\frac{1}{4}''$ tubing will provide for control line blow down to below 15 psig and provide dependable alarm activation.

Alert system pressure switches 53 and 54 can serve as the transducers to sense the loss of pressure in the control line 35 or 36, respectively. The switches can send a signal to an automatic shutdown or to an alarm system. The switches can function redundantly to, or in substitution of, storage system shutoff valves 37 and 38. When the pressure relief alert or pressure relief detecting apparatus according to the present invention activates, the shutoff valves 37 and 38 lose control pressure and close, thereby preventing additional loss from the product storage tank or supply source line and further isolating each vessel so storage from the other vessel is not discharged through the venting tank.

The pressure relief detecting/alert apparatus provides a method to detect the activation of pressure relief devices on storage tanks at a remote location. When such detection occurs, numerous functions can be accomplished automatically. A charging pump delivering stored fluid to the storage tank can be shut down to prevent excessive product loss to the atmosphere. In the case of a tube trailer or a railroad car, a pressure transfer can be stopped by activation of a control valve, e.g. a pneumatic or solenoid valve. A three-way valve can be activated on a liquid container after the pressure has decreased to a safe level to shutoff a blown disc and activate another disc or pressure relief device. The production of a product to be stored can be stopped. A single vessel with a blown rupture disc automatically can be isolated with a solenoid or pneumatic valve directly associated with the storage vessel in the system. An alarm to alert operators at a remote location can be activated. Safety equipment can be activated such as a deluge system, gas analyzers, or personnel evacuation alarms.

The instrument air supply for the control line of the relief alert system can be plant instrument air, can be supplied by a nitrogen cylinder located nearby, or can be supplied from the storage tank employing the pressure relief alert system through a pressure regulator if the stored fluid is acceptable for this use and thereby allowing the storage system to be self-contained.

The relief alert device can be used for several vent stacks to reduce cost if the stacks are close together. A properly shaped vent stack cover or plate can be used for several stacks simultaneously.

It is contemplated that gases such as ethane, ethylene, carbon monoxide, hydrogen, and methane are attractive candidates for the use of the pressure relief alert apparatus. However, the apparatus will also be practical for applications such as the storage of argon, nitrogen, or oxygen used with critical automatic pumping systems or when reliability of the storage system is critical such as for oxygen in hospitals. Numerous other applications are contemplated, and the apparatus will be useful whenever flammable, toxic, or otherwise hazardous fluids are to be stored in a pressurized tank.

I claim:

1. In a pressurized fluid storage apparatus including a storage tank capable of containing a stored fluid under pressure, said tank having a conduit for filling and withdrawing said stored fluid and a pressure relief device having a fluid release port for releasing said stored fluid at a predetermined pressure; the improvement comprising: means for detecting the activation of said pressure relief device, said means including an impermeable rigid cover over said fluid release port, said cover adapted to move in response to a release of stored fluid through said port; a pressurized tube assembly containing a control fluid, said tube assembly including a portion of reduced strength to facilitate rupture thereof, whereby movement of said cover responsive to release of fluid from said tankruptures said tube assembly and releases said control fluid; and means for detecting release of control fluid from said tube assembly.

2. The apparatus according to claim 1 wherein said pressurized tube assembly comprises a pressuized line tube removably connected to an indicator tube juxtaposed to said cover, said indicator tube having a circumferential groove to facilitate rupture of said indicator tube by movement of said cover.

3. The apparatus according to claim 2 wherein said pressurized line tube is fixed on one side of a support, said support adapted to act as a cantilever support for said grooved indicator tube.

4. The apparatus according to claim 3 wherein said means for detecting said control fluid release comprises at least one pneumatic switch mounted for activation by loss of pressure in said pressurized line tube at a location remote from said pressure relief pipe outlet.

5. The apparatus according to claim 4 wherein said grooved indicator tube has affixed thereto a force plate juxtaposed to, and having a surface area of about the area of, said impermeable rigid cover.

6. The apparatus according to claim 5 further comprising a safety chain connected to said grooved indicator tube and said support.

7. A pressure relief alert apparatus comprising:

(a) a tank containing a stored fluid at a pressure higher than atmospheric; (b) a pressure relief pipe having an inlet in communication with said stored fluid in said tank and an outlet; (c) means for discharging said stored fluid at a predetermined pressure through said pressure relief pipe; (d) a pressurized tube containing a control fluid in combination with a pressurized break-away tube assembly and a means for detachably connecting said pressurized tube to the break-away tube assembly wherein said pressurized tube is held rigidly immovable at a position in close proximity to said connecting means and said pressurized break-away tube assembly, and wherein said break-away tube assembly further includes a break-away tube open only at an end communicating with said connecting means, with a scored circumference located at a position exterior to said connecting means, but in close proximity thereto, when said pressurized break-away tube assembly is connected to said pressurized line tube; (e) a force plate attached to said break-away tube assembly and located over said relief pipe outlet, said force plate adapted to move in response to a release of fluid through said pipe; whereby a movement of said force plate in response to fluid release through said relief pipe breaks said break-away tube and releases said control fluid; and (f) means for detecting said release of said control fluid.

8. The apparatus according to claim 7 wherein said means for detecting said control fluid release includes at least one pneumatic switch at a remote location from said pressure relief pipe outlet.

9. The apparatus according to claim 8 further comprising an impermeable, rigid cover over said pressure relief pipe outlet, said cover adapted to move in response to said discharge of stored fluid and therupon to contact said force plate.

10. The apparatus according to claim 5 or claim 11 further comprising a pressurized source line and an orifice for supplying said control fluid to said pressurized line tube.

11. The apparatus according to claim 10 wherein said pressure relief device comprises a pressure relief valve or a rupture disc and holder.

12. The apparatus according to claim 11 further comprising an alarm activated by said pneumatic switch.

13. The apparatus according to claim 12 further comprising means for charging said tank with said stored fluid through said conduit, said charging means being controllably deactivated in response to said pneumatic switch.

* * * * *

UNITED STATES PATENT AND TRADEMARK OFFICE

CERTIFICATE OF CORRECTION

PATENT NO. : 4,438,792

DATED : March 27, 1984

INVENTOR(S) : George A. Timberlake, Jr.

It is certified that error appears in the above-identified patent and that said Letters Patent is hereby corrected as shown below:

Column 5, Line 36

Delete "tankruptures" and substitute therefor -- tank ruptures -

Column 6, Line 43

Delete "11" and substitute therefor -- 8 --

Signed and Sealed this

*Thirteenth* Day of *November 1984*

[SEAL]

*Attest:*

GERALD J. MOSSINGHOFF

*Attesting Officer*

*Commissioner of Patents and Trademarks*